US008851916B2

(12) United States Patent
Chen

(10) Patent No.: US 8,851,916 B2
(45) Date of Patent: Oct. 7, 2014

(54) CARD EDGE CONNECTOR WITH IMPROVED LOCKING ARM

(71) Applicant: Kunshan Jiahua Electronics Co., Ltd., Kunshan (CN)

(72) Inventor: Wei Chen, Kunshan (CN)

(73) Assignee: Kunshan Jiahua Electronics Co., Ltd., Kunshan, Jiangsu Providence (CN)

( * ) Notice: Subject to any disclaimer, the term of this patent is extended or adjusted under 35 U.S.C. 154(b) by 0 days.

(21) Appl. No.: 13/872,061

(22) Filed: Apr. 26, 2013

(65) Prior Publication Data

US 2013/0309892 A1 Nov. 21, 2013

(30) Foreign Application Priority Data

May 17, 2012 (CN) ..... 2012 1 0153207
May 17, 2012 (CN) ..... 2012 1 0153208

(51) Int. Cl.
*H01R 13/62* (2006.01)
*H01R 13/627* (2006.01)
*H01R 12/70* (2011.01)
*H01R 12/72* (2011.01)

(52) U.S. Cl.
CPC ..... *H01R 13/6275* (2013.01); *H01R 12/7029* (2013.01); *H01R 12/721* (2013.01)
USPC ..... 439/327; 439/328

(58) Field of Classification Search
USPC ..... 439/326–328
See application file for complete search history.

(56) References Cited

U.S. PATENT DOCUMENTS

| | | | | |
|---|---|---|---|---|
| 5,779,494 | A * | 7/1998 | Ito et al. | 439/326 |
| 5,839,913 | A * | 11/1998 | Fumikura | 439/326 |
| 6,250,953 | B1 * | 6/2001 | Niitsu | 439/497 |
| 6,276,951 | B1 * | 8/2001 | Chen et al. | 439/327 |
| 6,312,279 | B1 * | 11/2001 | Rachui et al. | 439/377 |
| 7,494,361 | B2 * | 2/2009 | Ho | 439/326 |
| 7,677,907 | B2 * | 3/2010 | Guan et al. | 439/157 |
| 7,789,692 | B2 * | 9/2010 | Lee | 439/327 |

FOREIGN PATENT DOCUMENTS

CN 102347536 A 2/2012

* cited by examiner

*Primary Examiner* — Briggitte R Hammond
(74) *Attorney, Agent, or Firm* — Cheng-Ju Chiang

(57) ABSTRACT

A card edge connector includes an insulative housing, a number of contacts and a pair of locking arms for holding a card. Each locking arm includes a retaining portion fixed to the insulative housing and a resilient arm extending forwardly from the retaining portion. The resilient arm is deformable outwardly so as to lock or unlock with the card. The resilient arm includes an engaging portion extending inwardly and a hook at a front of the engaging portion. The engaging portion includes a downwardly inclined surface for guiding installation of the card. The hook protrudes upwardly beyond the engaging portion so that when the card is not so inserted along a card-insertion direction, even if the card is downwardly pressed, a top edge of the hook resists against the card so as to prevent the card from further downward movement.

20 Claims, 6 Drawing Sheets

CARD EDGE CONNECTOR WITH IMPROVED LOCKING ARM

BACKGROUND OF THE INVENTION

1. Field

The present invention relates to a card edge connector, and more particularly to a card edge connector with improved locking arms for preventing an inserted card from being pressed downwardly when the inserted card is not so inserted to a predetermined position.

2. Description of the Related Art

Chinese Patent Publication No. CN 102347536A published on Feb. 8, 2012 discloses a card edge connector for being soldered to a mother PCB for insertion of a daughter PCB so as to establish electrical connection therebetween. The daughter PCB includes a pair of side edges each of which defines a cutout for being locked by the card edge connector. The card edge connector includes an insulative housing, a plurality of contacts retained in the insulative housing and a pair of locking arms attached to lateral sides of the insulative housing for holding the daughter PCB. The insulative housing defines a central card-receiving slot. Each locking arm includes a first arm and a second arm mating with the first arm. The second arm includes a retaining portion fixed to the insulative housing, a connecting arm extending forwardly from the retaining portion and a restricting portion at a front of the connecting arm. The restricting portion includes a locking portion inwardly bent from a front side thereof for locking with the cutout of the daughter PCB, an engaging portion pressing against the daughter PCB when it is installed in position, and a handle for being outwardly operated by finger. Both the engaging portion and the handle extend inwardly from a top edge of the connecting arm. The engaging portion includes a slant surface for guiding installation of the daughter PCB and a pressing surface for pressing against the daughter PCB when it is installed in position. The handle is of an arc configuration and extends downwardly and slantwise from the connecting arm. The handle is separated a distance from the engaging portion along a front-to-back direction and a bottom surface of the handle is higher than the pressing surface.

When the daughter PCB is inserted into the card edge connector, firstly, the daughter PCB is inserted into the card-receiving slot along a downward slope direction, and secondly, the daughter PCB is downwardly pressed. Lateral sides of the daughter PCB is downwardly moveable along the slant surfaces of the engaging portions, and simultaneously the locking arms move outwardly with the handles corresponding to the cutouts of the daughter PCB. When the daughter PCB is installed in position, the cutouts successfully pass the handles so that the daughter PCB can be pressed by the engaging portions. However, because of the slant arc configurations of the handles, even if the daughter PCB is not inserted to the predetermined position along the card insertion direction, once the daughter PCB is downwardly pressed, it can also move downwardly. Under this condition, the lateral sides of the daughter PCB can also engage the slant surfaces of the engaging portions, and simultaneously drive the locking arms moving outwardly. It is understandable that if the daughter PCB is not suitably inserted along the card insertion direction and the daughter PCB can also be pressed to lock with the locking arms, electrical connection between the contacts of the card edge connector and the daughter PCB will be unstable or even out of work.

Besides, since there is no upward limitation of the connecting arm and the restricting portion along a height direction of the card edge connector, when the daughter PCB is incorrectly uplifted from the card-receiving slot, the restricting portion together with the connecting arm might be torsionally deformed by the daughter PCB. As a result, electrical connection between the card edge connector and the daughter PCB will be influenced.

Hence, a card edge connector with foolproof and reliable locking arms is desired.

BRIEF SUMMARY OF THE INVENTION

The present invention provides a card edge connector including an insulative housing, a plurality of contacts fixed to the insulative housing and a pair of locking arms attached to lateral sides of the insulative housing. The insulative housing extends along a longitudinal direction and defines a card-receiving slot for receiving a card. The contacts include contacting portions extending into the card-receiving slot from top and bottom sides thereof. Each locking arm includes a retaining portion fixed to the insulative housing and a resilient arm extending forwardly from the retaining portion. The resilient arm is deformable outwardly so as to lock or unlock with the card. The resilient arm includes an engaging portion extending inwardly and a hook at a front of the engaging portion. The engaging portion includes a downwardly inclined surface for guiding installation of the card and a bottom surface for pressing against a top surface of the card when the card is installed in position. The hook comprises a top edge, a bottom edge and a locking surface between the top edge and the bottom edge. The top edge protrudes upwardly beyond the engaging portion so that when the card is not so inserted along a card-insertion direction to a predetermined position, even if the card is downwardly pressed, the top edge of the hook resists against the card so as to prevent the card from further downward movement.

The present invention also provides a card edge connector including an insulative housing, a plurality of contacts fixed to the insulative housing and a pair of locking arms attached to lateral sides of the insulative housing. The insulative housing extends along a longitudinal direction and defines a card-receiving slot for receiving a card. The contacts include contacting portions extending into the card-receiving slot from top and bottom sides thereof. Each locking arm includes a retaining portion fixed to the insulative housing, a resilient arm deformable outwardly so as to lock or unlock with the card and a restricting arm located outside of the resilient arm for limiting deformation of the resilient arm. The resilient arm includes an engaging portion extending inwardly and a hook at a front of the engaging portion. The engaging portion includes a downwardly inclined surface for guiding installation of the card. The resilient arm comprises a slot at a front of the hook and the restricting arm comprises a tab extending through the slot so that movement of the resilient arm along a height direction of the card edge connector can be limited.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENTS

Figure 1:
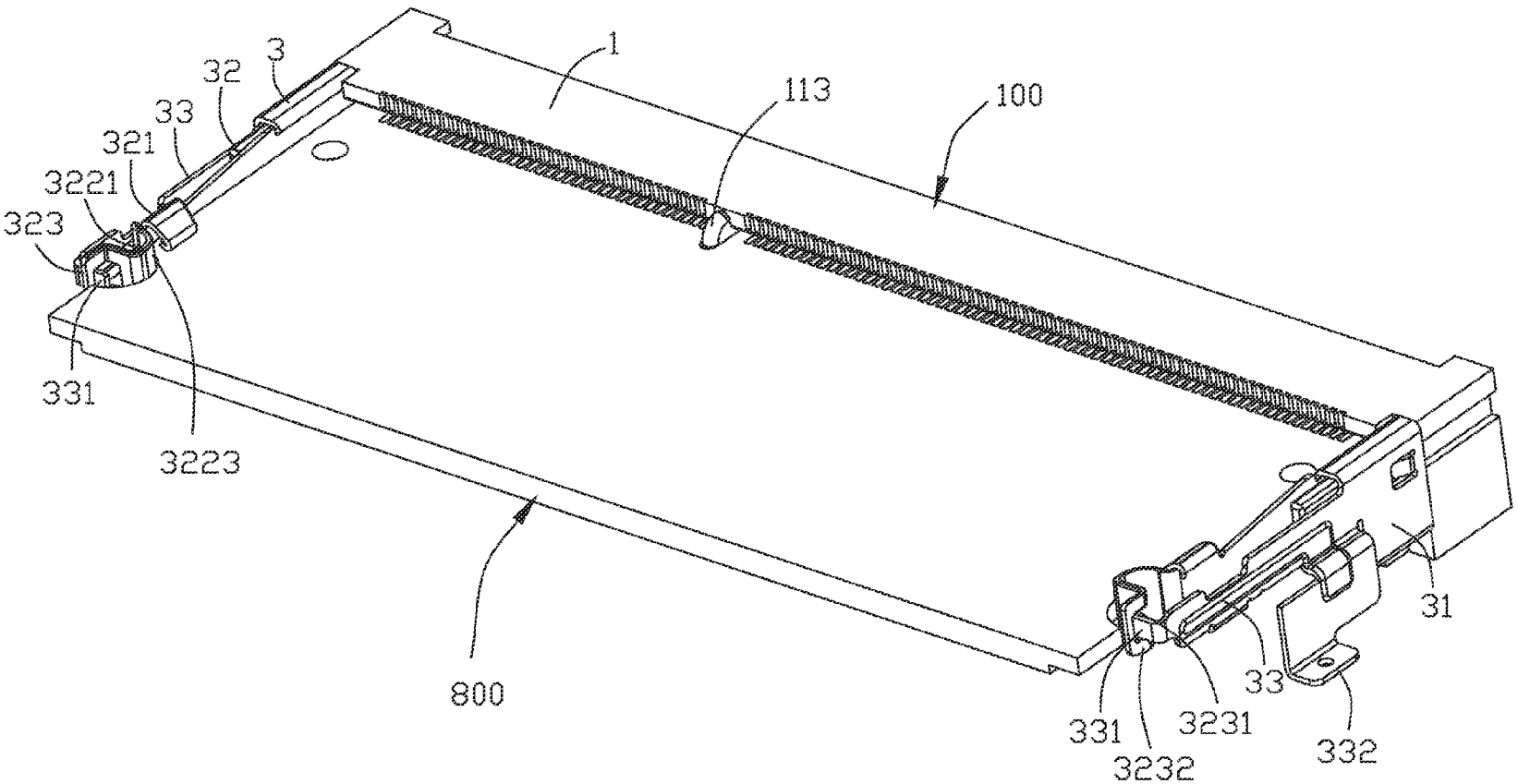
FIG. 1 is a perspective view of a card edge connector with a card inserted therein in accordance with an illustrated embodiment of the present invention.

Reference will now be made to the drawing figures to describe the embodiments of the present invention in detail. In the following description, the same drawing reference numerals are used for the same elements in different drawings.

Referring to FIGS. 1 to 6, the present invention discloses a card edge connector 100 for being soldered to a mother PCB (not shown) for insertion of a card 800 (i.e. a daughter PCB) so as to establish electrical connection therebetween according to an illustrated embodiment of the present invention. The card 800 includes two rows of golden fingers 801 formed on top and bottom surfaces thereof and a pair of side edges 802. Each side edge 802 defines a cutout 803 for being locked by the card edge connector 100 when the card 800 is installed in position. The card edge connector 100 includes an insulative housing 1 extending along a longitudinal direction, a plurality of contacts 2 retained in the insulative housing 1 and a pair of metal locking arms 3 attached to lateral sides of the insulative housing 1 for holding the card 800.

Figure 5:
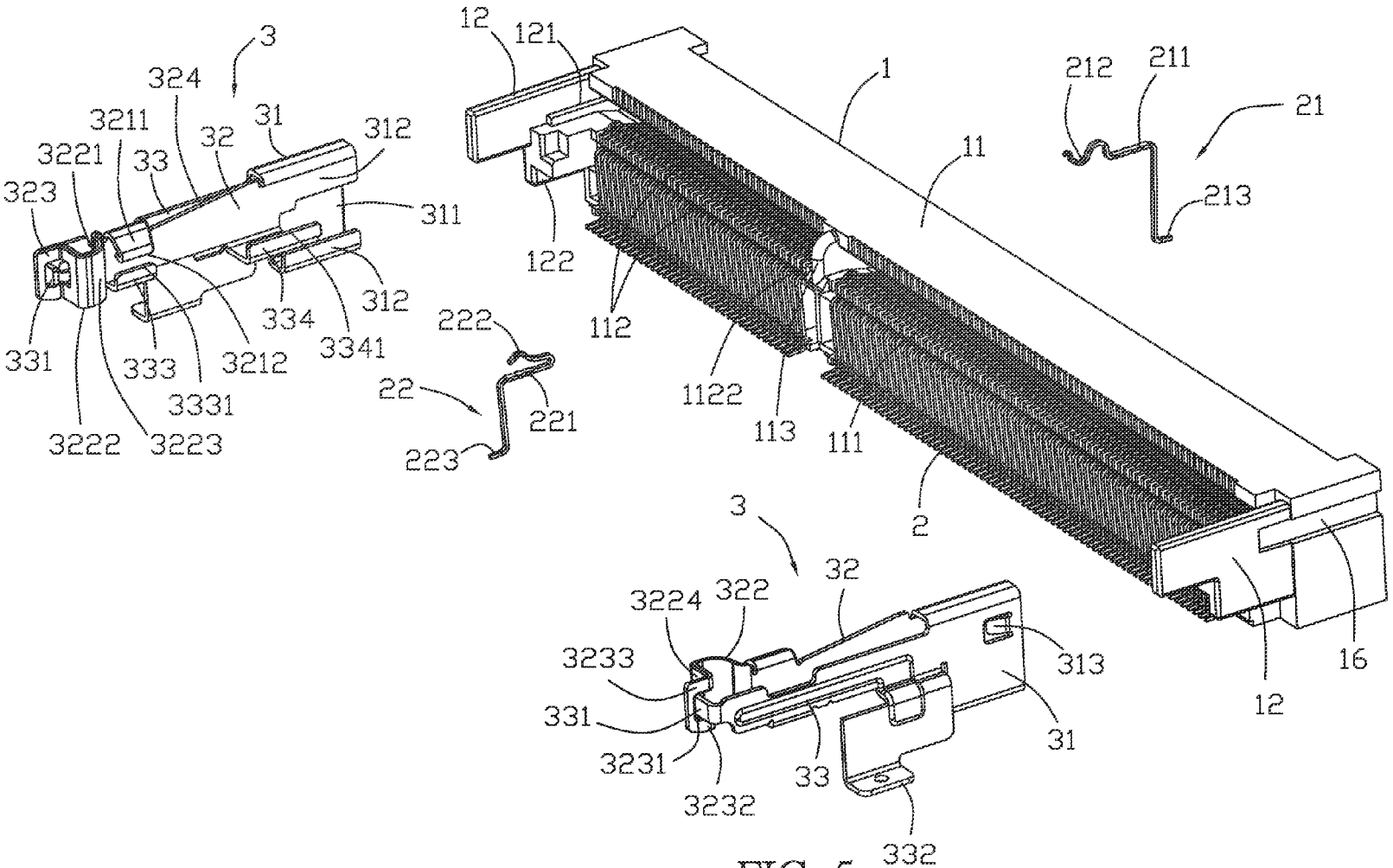
FIG. 5 is a partly exploded view of the card edge connector as shown in FIG. 3 with a pair of locking arms separated therefrom.
Figure 6:
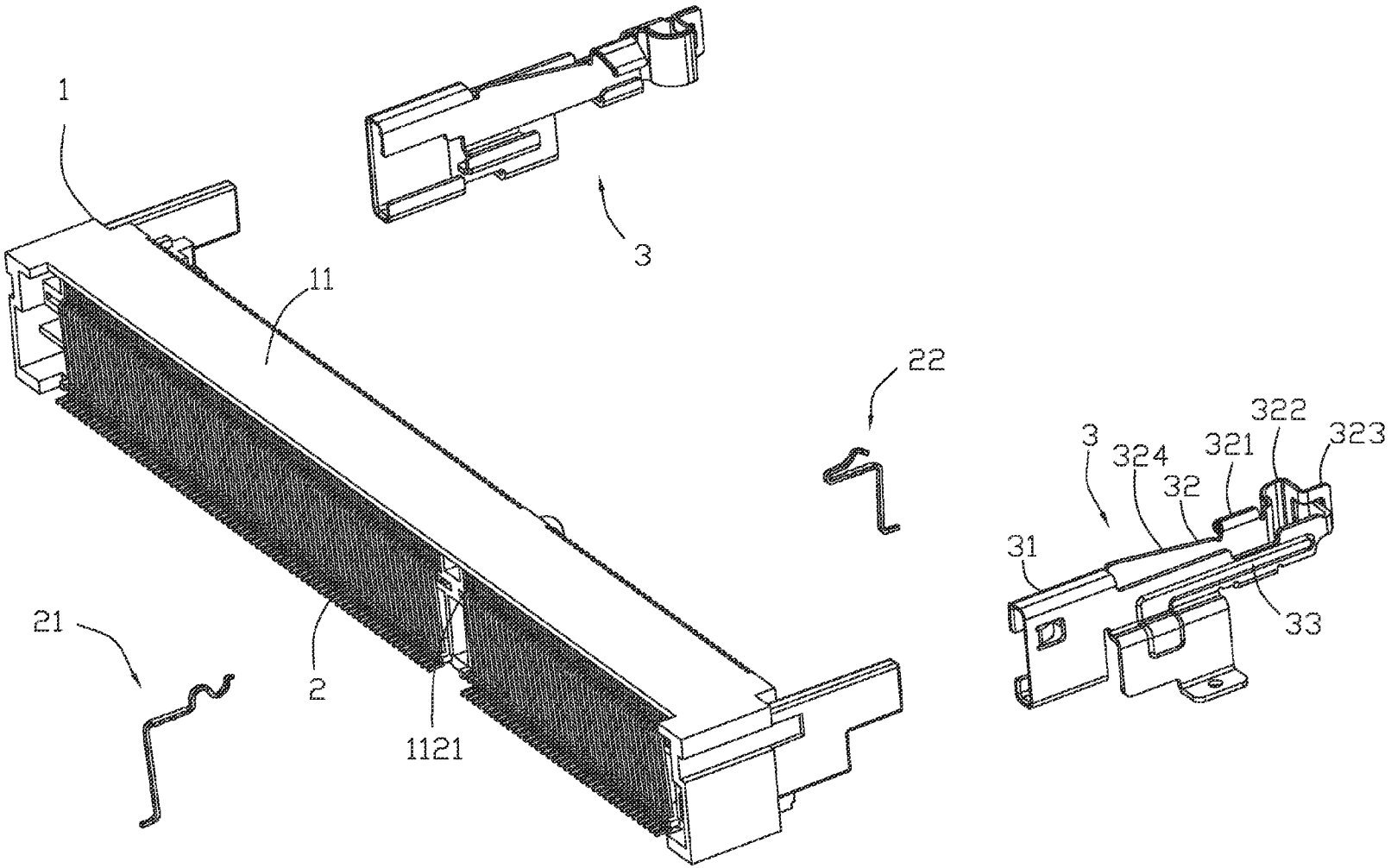
FIG. 6 is another partly exploded view of the card edge connector as shown in FIG. 5.

Referring to FIGS. 5 and 6, the insulative housing 1 includes a body portion 11 and a pair of side walls 12 extending forwardly from lateral sides of the body portion 11. The body portion 11 includes a card-receiving slot 111 for receiving the card 800, a plurality of passageways 112 in communication with the card-receiving slot 111 for receiving the contacts 2 and a separate wall 113 located in the card-receiving slot 111. The card-receiving slot 111 is located at central of the body portion 11 and is opened to a front side. The passageways 112 include a plurality of first passageways 1121 on top of the card-receiving slot 111 and a plurality of second passageways 1122 on bottom of the card-receiving slot 111. The first and the second passageways 1121, 1122 and the card-receiving slot 111 are in communication with each other along a height direction of the card edge connector 100. The separate wall 113 is integrally form with the main body 111 and separates the card-receiving slot 111 into two parts with different lengths in order that the card 800 cannot be reversely inserted into the card-receiving slot 111. The side walls 12 are symmetrical with each other and each includes a top positioning recess 121 extending along a front-to-back direction, a bottom positioning rib 122 extending along the front-to-back direction and a positioning slot 16 formed on an outside surface thereof.

Referring to FIGS. 3 to 6, the contacts 2 include a plurality of first contacts 21 fixed in the first passageways 1121 and a plurality of second contacts 22 fixed in the second passageways 1122. The first contacts 21 are inserted into the first passageways 1121 from a rear side of the body portion 11 and each first contact 21 includes a first retaining portion 211 fixed in the first passageway 1121, a first contacting portion 212 extending into the card-receiving slot 111 and a first soldering portion 213 extending backwardly beyond the body portion 11 for soldering to the mother PCB. The second contacts 22 are inserted into the second passageways 1122 from a front side of the body portion 11 and each second contact 22 includes a second retaining portion 221 fixed in the second passageway 1122, a second contacting portion 222 extending into the card-receiving slot 111 and a second soldering portion 223 extending forwardly beyond the body portion 11 for soldering to the mother PCB. The first contacting portions 212 and the second contacting portions 222 are adapted for electrically contacting the golden fingers 801 of the card 800 so as to establish electrical connection therebetween for signal transmission.

Referring to FIGS. 1 to 6, the locking arms 3 are symmetrical with each other and each locking arm 3 is of a unitary one piece. Each locking arm 3 includes a retaining portion 31 fixed to side wall 12 of the insulative housing 1, a resilient arm 32 extending forwardly from the retaining portion 31 and a restricting arm 33 extending forwardly from the retaining portion 31 and located outside of the resilient arm 32. The retaining portion 31 includes a base 311 covering the outside surface of the side wall 12, a pair of upper and lower locking pieces 312 fixed to the side wall 12 and a protrusion 313 stamped inwardly from the middle of the base 311. The protrusion 313 is lockable with the positioning slot 16 so as to prevent the locking arm 3 from moving forwardly. The upper locking piece 312 is received in the top positioning recess 121 and downwardly presses the side wall 12. The lower locking piece 312 is lockable to the bottom positioning rib 122 from a bottom side of the side wall 12. As a result, upward and downward movements of the retaining portion 31 can be avoided.

The resilient arm 32 extends forwardly from the upper locking piece 312. The resilient arm 32 includes an inclined top surface 324, an engaging portion 321 bent downwardly and inwardly from the top surface 324, a hook 322 at a front of the engaging portion 321 for locking with corresponding cutout 803 of the card 800, a first vertical wall 3224 bent outwardly from the hook 322 and a second vertical wall 323 extending forwardly from the first vertical wall 3224. The top surface 324 extends downwardly and slantwise towards the hook 322 so as to improve elasticity of the resilient arm 32. The engaging portion 321 includes a downwardly inclined surface 3211 for guiding installation of the card 800 and a bottom surface 3212 for pressing against a top surface of the card 800 when the card 800 is installed in position. The hook 322 extends inwardly beyond the engaging portion 321 along the longitudinal direction and includes a top edge 3221, a bottom edge 3222 and a locking surface 3223 between the top edge 3221 and the bottom edge 3222. The top edge 3221 protrudes upwardly beyond the engaging portion 321 so that when the card 800 is not so inserted along a card-insertion direction to a predetermined position, even if the card 800 is downwardly pressed, the top edge 3221 of the hook 322 resists against the card 800 so as to prevent the card 800 from further downward movement. The locking surface 3223 is essentially of one fourth cylindrical surface and is configured to meet at least part of the cutout 803 of the card 800. The second vertical wall 323 is perpendicular to the first vertical wall 3224. The second vertical wall 323 defines a slot 3231, a bottom wall 3232 on bottom of the slot 3231 and a top wall 3233 on top of the slot 3231.

The restricting arm 33 is adapted for limiting deformation of the resilient arm 32. The restricting arm 33 is located outside of the resilient arm 32 so that outward over-deformation of the resilient arm 32 can be prevented when the card 800 is inserted. Besides, the restricting arm 33 includes a stop wall 333 extending inwardly beyond the resilient arm 32 so as to prevent the resilient arm 32 from inward over-deformation under external force. The stop wall 333 extends inwardly and upwardly from a bottom surface of the restricting arm 33. The stop wall 333 is located at a rear of the hook 322 and is in alignment with the engaging portion 321 along the height direction of the card edge connector 100. Furthermore, the restricting arm 33 includes a tab 331 bent towards the second vertical wall 323 and extending through the slot 3231 so that movement of the resilient arm 32 along the height direction of the card edge connector 100 can be limited. In detail, the bottom wall 3232 is capable of abutting against the tab 331 so as to restrict upward movement of the resilient arm 32 when the card 800 is incorrectly uplifted. The top wall 3233 is capable of abutting against the tab 331 so as to restrict downward movement of the resilient arm 32 when the card 800 is incorrectly depressed. Besides, the restricting arm 33 includes a support wall 334 extending inwardly and upwardly from the bottom surface of the restricting arm 33. The support wall 334 and the stop wall 333 are separated a distance from each other along the front-to-back direction. The support wall 334 is located inside the stop wall 333. Top edges 3341, 3331 of the support wall 334 and the stop wall 333 are coplanar with each other for jointly supporting the card 800 when the card 800 is downwardly pressed in position. The restricting arm 33 further includes a soldering section 332 extending outwardly from the bottom surface thereof. The soldering section 332 is soldered to the mother PCB so that the restricting arm 33 can be stably fixed on the mother PCB. As a result, over-deformations along inward, outward, upward and downward directions of the resilient arm 32 can all be well controlled.

Figure 2:
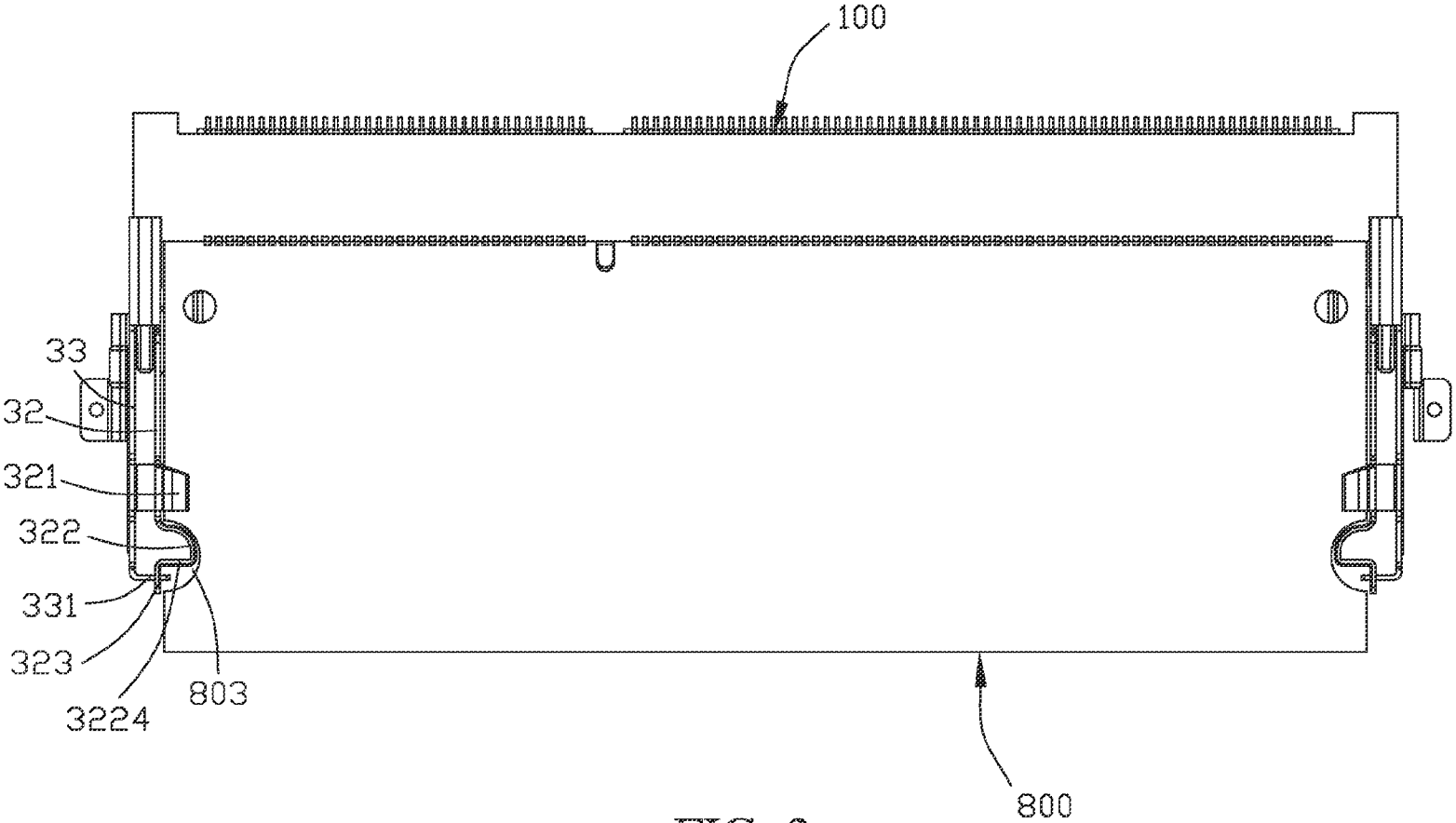
FIG. 2 is a top view of the card edge connector as shown in FIG. 1.
Figure 3:
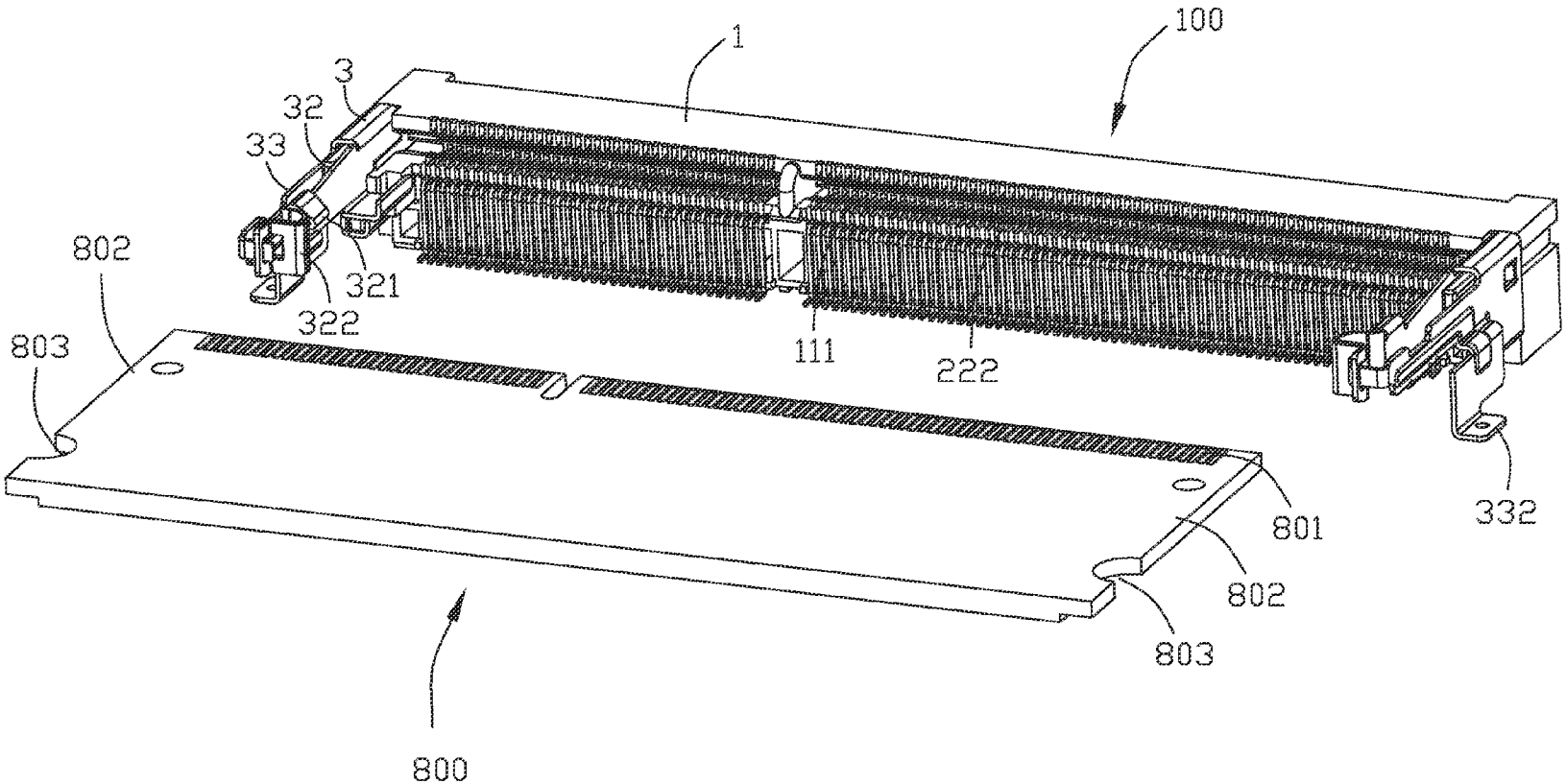
FIG. 3 is a perspective view of the card edge connector with the card separated therefrom.
Figure 4:
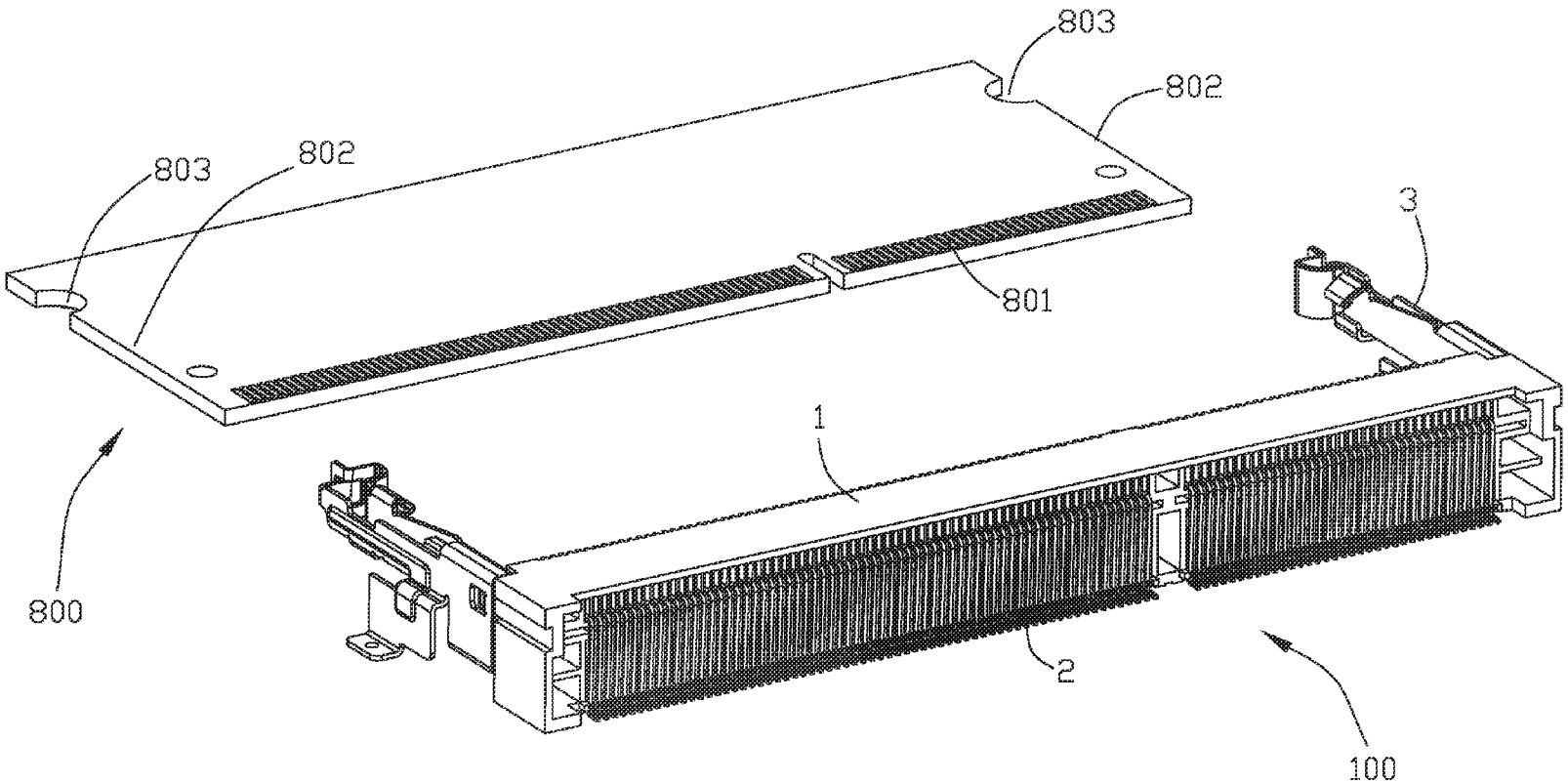
FIG. 4 is another perspective view of the card edge connector with the card separated therefrom while taken from a different aspect.

When the card 800 is installed in the card edge connector 100, two steps are included. Firstly, the card 800 is inserted into the card-receiving slot 111 along a downward slope direction until the card 800 reaches the predetermined position along the card insertion direction. Secondly, the card 800 is downwardly pressed to a horizontal plane. During the first step, the first contacting portions 212 and the second contacting portions 222 contact the golden fingers 801 of the card 800. During the second step, the card 800 is guided by the inclined surface 3211 so that horizontal outward forces generate which will outwardly drive the resilient arms 32. Simultaneously, with the card 800 approaches to the horizontal plane, the hooks 322 can successfully pass the cutouts 803 of the card 800. As shown in FIGS. 1 and 2, once the card 800 is installed in position, the engaging portions 321 release their elasticity so that the top surface of the card 800 can be pressed by the bottom surfaces 3212. The locking surfaces 3223 are lockable with the cutout 803 for stably holding the card 800.

However, in the first step, if the card 800 is not so inserted along the card-insertion direction to the predetermined position, even if the card 800 is downwardly pressed, the top edges 3221 of the hooks 322 resist against the card 800. Under this condition, the card 800 is stopped by the top edges 3221 of the hooks 322 and thereby the card 800 cannot drive the engaging portions 321. That is to say, under this condition, no horizontal outward force generates and the resilient arms 32 cannot move outwardly. As a result, the card 800 can be prevented from further downward movement. The top edges 3221 of the hooks 322 act as foolproof structures under unsuitable installation of the card 800.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A card edge connector comprising:

an insulative housing extending along a longitudinal direction and defining a card-receiving slot for receiving a card;

a plurality of contacts with contacting portions extending into the card-receiving slot from top and bottom sides thereof; and a pair of locking arms attached to lateral sides of the insulative housing, each locking arm comprising a retaining portion fixed to the insulative housing and a resilient arm extending forwardly from the retaining portion, the resilient arm being deformable outwardly so as to lock or unlock with the card, the resilient arm comprising an engaging portion extending inwardly and a hook at a front of the engaging portion, the engaging portion comprising a downwardly inclined surface for guiding installation of the card and a bottom surface for pressing against a top surface of the card when the card is installed in position; wherein the hook comprises a top edge, a bottom edge and a locking surface between the top edge and the bottom edge, the top edge protruding upwardly beyond the engaging portion so that when the card is not so inserted along a card-insertion direction to a predetermined position, even if the card is downwardly pressed, the top edge of the hook resists against the card so as to prevent the card from further downward movement.

2. The card edge connector as claimed in claim 1, wherein the hook extends inwardly beyond the engaging portion along the longitudinal direction.

3. The card edge connector as claimed in claim 1, wherein the locking surface is essentially of one fourth cylindrical surface and is configured to meet at least part of a cutout of the card.

4. The card edge connector as claimed in claim 1, wherein the resilient arm comprises a top surface extending downwardly and slantwise towards the hook, and the engaging portion is bent downwardly from the top surface.

5. The card edge connector as claimed in claim 1, wherein each locking arm further comprises a restricting arm located outside of the resilient arm for preventing outward over-deformation of the resilient arm when the card is inserted.

6. The card edge connector as claimed in claim 5, wherein the restricting arm comprises a stop wall extending inwardly beyond the resilient arm so as to prevent the resilient arm from inward over-deformation.

7. The card edge connector as claimed in claim 6, wherein the stop wall extends inwardly and upwardly from a bottom surface of the restricting arm, the stop wall is located at a rear of the hook and is in alignment with the engaging portion along a height direction of the card edge connector.

8. The card edge connector as claimed in claim 7, wherein the restricting arm comprises a support wall extending inwardly and upwardly from the bottom surface of the restricting arm, the support wall and the stop wall being separated a distance from each other along a front-to-back direction, the support wall being located inside the stop wall, top edges of the support wall and the stop wall being coplanar with each other for jointly supporting the card when the card is downwardly pressed.

9. The card edge connector as claimed in claim 5, wherein the resilient arm comprises a first vertical wall bent outwardly from the locking surface and a second vertical wall extending forwardly from the first vertical wall, the first vertical wall being perpendicular to the second vertical wall, the second vertical wall defining a slot, the restricting arm comprising a tab bent towards the second vertical wall and extending through the slot.

10. The card edge connector as claimed in claim 9, wherein the second vertical wall comprises a top wall and a bottom wall with the slot formed therebetween, the top wall and the bottom wall abutting against the tab so as to restrict downward movement and upward movement of the resilient arm, respectively.

11. The card edge connector as claimed in claim 1, wherein the insulative housing comprises a body portion and a pair of side walls extending forwardly from lateral sides of the body portion, the card-receiving slot being formed on the body portion, the retaining portion comprising a pair of upper and lower locking pieces fixed to corresponding side wall.

12. A card edge connector comprising:

an insulative housing extending along a longitudinal direction and defining a card-receiving slot for receiving a card;

a plurality of contacts with contacting portions extending into the card-receiving slot from top and bottom sides thereof; and a pair of locking arms attached to lateral sides of the insulative housing, each locking arm comprising a retaining portion fixed to the insulative housing, a resilient arm deformable outwardly so as to lock or unlock with the card and a restricting arm located outside of the resilient arm for limiting deformation of the resilient arm, the resilient arm comprising an engaging portion extending inwardly and a hook at a front of the engaging portion, the engaging portion comprising a downwardly inclined surface for guiding installation of the card; wherein the resilient arm comprises a slot at a front of the hook and the restricting arm comprises a tab extending through the slot so that movement of the resilient arm along a height direction of the card edge connector can be limited.

13. The card edge connector as claimed in claim 12, wherein the resilient arm comprises a bottom wall on bottom of the slot, the bottom wall abutting against the tab so as to restrict upward movement of the resilient arm.

14. The card edge connector as claimed in claim 13, wherein the resilient arm comprises a top wall on top of the slot, the top wall abutting against the tab so as to restrict downward movement of the resilient arm.

15. The card edge connector as claimed in claim 12, wherein the resilient arm comprises a first vertical wall bent outwardly from the hook and a second vertical wall extending forwardly from the first vertical wall, the first vertical wall being perpendicular to the second vertical wall, the second vertical wall defining the slot, the tab being perpendicularly bent towards the second vertical wall.

16. The card edge connector as claimed in claim 12, wherein the hook comprises a top edge, a bottom edge and a locking surface between the top edge and the bottom edge, the top edge protruding upwardly beyond the engaging portion so that when the card is not so inserted along a card-insertion direction to a predetermined position, even if the card is downwardly pressed, the top edge of the hook resists against the card so as to prevent the card from further downward movement.

17. The card edge connector as claimed in claim 16, wherein the hook extends inwardly beyond the engaging portion along the longitudinal direction, the locking surface is essentially of one fourth cylindrical surface and is configured to meet at least part of a cutout of the card.

18. The card edge connector as claimed in claim 12, wherein the restricting arm comprises a stop wall extending inwardly beyond the resilient arm so as to prevent the resilient arm from inward over-deformation.

19. The card edge connector as claimed in claim 18, wherein the stop wall extends inwardly and upwardly from a bottom surface of the restricting arm, the stop wall being located at a rear of the hook and being in alignment with the engaging portion along the height direction of the card edge connector.

20. The card edge connector as claimed in claim 19, wherein the restricting arm comprises a support wall extending inwardly and upwardly from the bottom surface of the restricting arm, the support wall and the stop wall being separated a distance from each other along a front-to-back direction, the support wall being located inside the stop wall, top edges of the support wall and the stop wall being coplanar with each other for jointly supporting the card when the card is downwardly pressed.

* * * * *